US007194989B2

(12) United States Patent
Hallenbeck

(10) Patent No.: US 7,194,989 B2
(45) Date of Patent: Mar. 27, 2007

(54) ENERGY EFFICIENT CLEAN BURNING TWO-STROKE INTERNAL COMBUSTION ENGINE

(76) Inventor: Samuel Raymond Hallenbeck, 69525 Dillon Rd #93, Desert Hot Springs, CA (US) 92241

( * ) Notice: Subject to any disclaimer, the term of this patent is extended or adjusted under 35 U.S.C. 154(b) by 0 days.

(21) Appl. No.: 11/360,822

(22) Filed: Feb. 23, 2006

(65) Prior Publication Data

US 2006/0196456 A1 Sep. 7, 2006

Related U.S. Application Data

(60) Provisional application No. 60/658,805, filed on Mar. 3, 2005.

(51) Int. Cl.
*F02B 75/18* (2006.01)

(52) U.S. Cl. ..... 123/56.1; 123/73 AB

(58) Field of Classification Search ..... 123/56.1, 123/48 R, 78 B, 193.6, 73 AA, 73 AV, 73 AB
See application file for complete search history.

(56) References Cited

U.S. PATENT DOCUMENTS 2,431,859 A * 12/1947 Fisher ..... 123/47 A
2,825,319 A * 3/1958 Harrer ..... 123/46 A
3,089,305 A * 5/1963 Hobbs ..... 60/595
4,128,083 A * 12/1978 Bock ..... 123/46 R
4,480,599 A * 11/1984 Allais ..... 123/46 R
4,932,373 A * 6/1990 Carson ..... 123/197.4
5,002,020 A * 3/1991 Kos ..... 123/46 E
5,505,172 A * 4/1996 Heitland et al. ..... 123/257
5,509,382 A * 4/1996 Noland ..... 123/66
5,682,845 A * 11/1997 Woody ..... 123/73 A
5,865,092 A * 2/1999 Woudwyk ..... 92/216
6,532,916 B2 * 3/2003 Kerrebrock ..... 123/46 E
6,541,875 B1 * 4/2003 Berlinger et al. ..... 290/1 R
6,729,290 B1 * 5/2004 Rorke ..... 123/193.6
6,834,636 B2 * 12/2004 Thomas et al. ..... 123/241
2002/0134324 A1 * 9/2002 Wechner ..... 123/46 R
2003/0070634 A1 * 4/2003 Al Hawaj ..... 123/56.1
2004/0099228 A1 * 5/2004 Roberts ..... 123/55.7

* cited by examiner

*Primary Examiner*—Stephen K. Cronin
*Assistant Examiner*—Aaron N. Wilson
(74) *Attorney, Agent, or Firm*—Donald W. Meeker

(57) ABSTRACT

A precision cast engine has a piston unit and a rotor unit to translate linear thrust from the piston unit into rotary power. Each piston rod is attached to a thrust absorber carriage running on precision bearings to eliminate piston drag on the cylinder walls. One or more drive rods extend from the carriage each into a curved groove on a power rotor to rotate it to transmit power via one or more drive shafts connected to drive components of transportation or other devices. An air intake valve on each piston provides automatic self aspirating to force combusted gasses out and draw in a controlled recharge of air for the fuel air mix.

14 Claims, 3 Drawing Sheets

ENERGY EFFICIENT CLEAN BURNING TWO-STROKE INTERNAL COMBUSTION ENGINE

CROSS-REFERENCE TO RELATED APPLICATIONS

The present utility patent application claims the benefit of provisional application No. 60/658,805 filed Mar. 3, 2005.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to two-cycle engines and particularly to a clean operating efficient two-stroke engine comprising a precision cast engine in two separable parts for easy repair, a drive piston unit or units to provide the thrust and a driven rotor unit to translate linear thrust from the piston unit or units into rotary power transmitted to a transportation device or other devices, wherein the piston unit has one or more cylinders with each piston rod attached to a thrust absorber carriage running on precision bearings so that the piston does not touch the cylinder walls to eliminate piston drag for a full leveraged power stroke and the thrust absorber carriage has one or more drive rods extending into one or more driven units with cylindrical rotor drives having curved grooves in the outer surface for each to receive a drive rod in the groove to cause the rotor to rotate to transmit power via a single or double drive shaft connected to drive components of a transportation vehicle or other use so that the present invention provides a two stroke engine using full pressure lubrication through conduits to the moving parts so there is no oil in the fuel, an air intake valve on each piston for automatic self aspirating to force combusted gasses out and draw in a controlled recharge of air for the fuel air mix using controlled air valve and exhaust valve action and low pressure fuel injection, wherein the pistons run in parallel relation to the power shaft with no gears except the lubrication pump and very low power loss to operate the engine with the ability to drop or pickup cylinder operation at will (idle on one cylinder and engage others as needed).

2. Description of Related Art Including Information Disclosed Under 37 CFR 1.97 and 1.98

It is known that no internal combustion engine as built today can meet the weight to horsepower ratio of the two-stroke engine. To overcome the negative aspects of the old two-stroke design and produce an engine more friendly to the ecology seems more practical than to continue with the four-stroke variety. The advantage of a two-stroke engine is the less weight to horsepower, lower manufacturing cost (not as many parts) lower updating cost (no dead strokes to use up power) smaller size where size a problem, longer engine life, less air pollution, and a reduced drain on our oil reserves.

Typical two-stroke engines have no oil sump to lubricate the internal components of the engine. Therefore, oil is either mixed with the fuel prior to being drawn into the engine, or is injected directly into the crankcase area to provide the necessary lubrication. Both methods serve, to keep the weight of such engines low and make it possible to utilize two cycle engines in any position, but contribute substantial pollution to the environment and require frequent maintenance due to carbon build-up.

Older two stroke engines which were known to be the most efficient engines to build and operate with the highest horse power to weight ratio of any internal combustion engine ever built. Their problem was exhaust and intake porting, requiring the lubricant to be mixed with the fuel, which required a high head temperature to reduce the carbon deposits due to the oil-gas mixture and of course it was considered to be a dirty engine and was barred for use in the marine market.

Prior art two-stroke engines fail to adequately address the major problems typically associated with such engines.

Prior art U.S. Patent Application #20040099228, published May 27, 2004 by Roberts, shows a two stroke cycle internal combustion engine machine that does not require lubricating oil to be mixed with its fuel, producing greater efficiency, higher power to weight ratio, cooler operating temperatures, a wider speed range, greater simplicity, and lower toxic emissions, many of the improvements also transferable to four stroke engines.

Prior art U.S. Pat. No. 4,480,599, issued Nov. 6, 1984 to Allais, describes a free-piston engine formed by one or more units, each comprising a pair of opposed pistons connected to a common piston rod and movable within two opposed cylinders, with a load, such as the inductor of a linear alternator, connected to an intermediate point of the piston rod, and in which there is provided at least a cam controlled by an operatively independent motor and engaging at least a tappet connected to the piston rod of a unit of pistons. The tappet may alternately be a roller. The cam is profiled and controlled in such a way as to substantially follow the movement of the tappets which is produced by the free-piston engine during normal operation, but to limit the travel of the piston units and provide the energy for the compression stroke, in case of anomalous operation. The cam serves also to start the engine, as well as to mutually synchronize the various units of pairs of pistons in engines having a plurality of units. The engine may also be in the form of an adiabatic engine fed by coal dust or other solid fuel.

Prior art U.S. Pat. No. 5,002,020, issued Mar. 26, 1991 to Kos, indicates a computer optimized hybrid engine employing a reciprocating piston in conjunction with an electromagnetic transducer for control and power output. The transducer is essentially a specialized linear motor/generator. The piston is rigidly connected by means of a rod to a permanent magnet (or equivalent). The piston-rod-magnet unit is constrained by bearings to move translationally along one axis. The magnet can move linearly into and out of the yoke of the magnetic transducer to generate an electric current in the windings of the yoke. At the same time computer control of the effective impendences of these windings as well as computer controlled currents (provided by an electric storage battery or electrical energy storage indicator) flowing through some (or all) of these windings control the motion of the magnet and hence of the piston. Computer control is also exercised over other devices to regulate ignition timing, fuel injection, air intake, valve motion, etc. The power output may be used to drive A.C., D.C. or A.C./D.C. motors or it may be wholly or partially rectified to charge batteries and/or power A.C./D.C. or D.C. motors or to power other devices.

Prior art U.S. Pat. No. 6,532,916, issued Mar. 18, 2003 to Kerrebrock, is for an opposed piston linearly oscillating power unit. The piston/cylinder internal combustion unit has opposed pistons connected to a common rod and driven in an oscillatory and reciprocating movement. The pistons operate out of phase with each other, such that the power stroke of one drives the compression stroke of the other, and a spring acts on the rod storing energy or exerting a restorative force as the rod is displaced with piston movement. Preferably, the moving rod carries a coil assembly near a stationary magnet (or a magnet near a stationary coil assembly) to produce electricity at the oscillatory frequency. The engine may employ a mechanical spring, an electromagnetic or a magnetic spring, or combinations thereof to stabilize or establish oscillation of the piston and rod assembly. The coil itself may fill this function and act to exert restoring force by coupling to an external control system that applies a control a signal to the coil in accordance with piston position to create an electromagnetic restoring force of appropriate level. The piston rod may couple to a first coil that acts as a spring, and a second coil that functions as an alternator to generate power. By driving the pistons in opposite phase, or by providing a magnetic/electromagnetic spring mechanism, a higher constant k is achieved, raising the frequency of oscillation and increasing power output of the engine.

Prior art U.S. Pat. No. 4,128,083, issued Dec. 5, 1978 to Bock, provides a gas cushioned free piston type engine which comprises two oppositely arranged combustion cylinders and a pair of pistons reciprocably mounted therein, which are rigidly connected to each other by a common piston rod. The engine includes further a pump cylinder provided in a central part of the engine located between the two combustion cylinders, a pump piston having opposite faces impingeable by fluid, fixed to the piston rod and dividing the pump cylinder into a pair of pump cylinder chambers, a common suction chamber and a common pressure chamber, which, together with inlet valves and outlet valves, are arranged in the central part of the engine.

Prior art U.S. Pat. No. 3,089,305, issued May 14, 1963 to Hobbs, shows an internal combustion engine with opposed engine cylinders mounted on the body, opposed reciprocating engine pistons in the engine cylinders, a piston rod fastened to the engine pistons to be reciprocated therewith, and a pump output unit, comprising a pump cylinder and a pump piston which is fixed to the piston rod. The piston rod is supported by the engine casing.

Prior art U.S. Pat. No. 2,825,319, issued Mar. 4, 1958 to Harrer, claims a free-piston engine-compressor apparatus which comprises a central part of the engine with two combustion cylinders arranged to opposite sides of the central part and fixedly connected thereto. The free pistons are reciprocably arranged in the two combustion cylinders and are rigidly connected to each other by a common piston rod. There are no rod support projections from the housing, therefore the pistons suffer more wear.

Prior art U.S. Pat. No. 4,932,373, issued Jun. 12, 1990 to Carson, discloses a motion converting mechanism. To reduce space requirements, vibrations and certain stresses in a motion converting mechanism, a rod is constrained to reciprocate within a housing where the rod is attached to the crankshaft by a cylindrical shaped connector that orbits around the crankpin in a direction opposite that of the crankshaft while rotating inside the rod. Through the center portion of each stroke, the connector also interfaces directly with the housing by such means as a cam cam-follower or gearing to eliminate a second degree of freedom at mid-stroke. The resulting motion defined for the center of the connector and the rod is sinusoidal being twice that of the motion of the crankpin in the axis of reciprocation. The resulting stroke is four times the crankpin offset. The motion converting mechanism has a double acting piston which includes piston/oil rings on both ends of piston. Piston/oil rings are also mounted in head. The head may include a raised projection in the direction of piston immediate to piston coupling rod with piston having a corresponding recess. The raised projection would extend out sufficiently from the head to the protect piston coupling rod from heat build up during the high temperatures encountered at the beginning of the combustion stroke.

Prior art U.S. Pat. No. 6,834,636, issued Dec. 28, 2004 to Thomas et al., is for an internal combustion barrel engine including an engine housing with a first and second end. An elongated power shaft is longitudinally disposed in the engine housing and defines a longitudinal axis. A combustion cylinder and a guide cylinder are spaced apart and disposed on a common cylinder axis that is generally parallel to the central axis. The cylinders each have an inner end and an outer end, with the inner ends being closer to each other. The outer end of the combustion cylinder is closed. An intake system is operable to introduce a mixture of air and/or fuel into the combustion cylinder. A track is supported between the inner ends of the cylinders and has an undulating cam surface. The track is moveable such that the portion of the cam surface most directly between the cylinders undulates toward and away from the inner end of the combustion cylinder. A double-ended piston includes a combustion end disposed in the combustion cylinder so as to define a combustion chamber between the combustion end and the closed end of the combustion cylinder. A guide end is disposed in the guide cylinder. A midportion extends between the combustion end and the guide end and is in mechanical communication with the guide surface of the track. A variable compression ratio device is operable to move the track axially towards and away from the inner end of the combustion cylinder so as to adjust the compression ratio. Combustion occurs only in the combustion cylinder and does not occur in the guide cylinder.

Prior art U.S. Pat. No. 6,541,875, issued Apr. 1, 2003 to Berlinger, puts forth a free piston internal combustion engine with electrical power output, particularly suitable for use in a vehicle having an electric motor as a prime mover, has a combustion cylinder, a piston reciprocally disposed within the cylinder, and a piston rod coupled with a piston. An annular bearing carried within the housing guides the piston rod within generator/motor cylinder. A linear electric generator/motor includes at least one magnet carried by the piston rod and at least one coil positioned in association with the at least one magnet. An electrical circuit is coupled with each of the at least one coil and a battery. The at least one magnet induces an electrical current within the coil to energize a capacitor within the electrical circuit. The charge from the capacitor may be used to charge the battery. The capacitor and/or battery provide output electrical current which is used to drive the electric motor.

What is needed is an improvement of the old two-stroke engine which is pressure lubricated requiring no oil in the fuel, and consequently does not need a high temperature cylinder head to burn the excess carbon created by the oil in the fuel as found in prior two-stroke engine, and for greater efficiency and cleaner burning, has one air intake and two exhaust valves per cylinder, is fuel injected, and has most of the moving parts operating on roller bearings or lubricated slides.

BRIEF SUMMARY OF THE INVENTION

An object of the present invention is to provide an improvement of the old two-stroke engine which is pressure lubricated requiring no oil in the fuel, and consequently does not need a high temperature cylinder head to burn the excess carbon created by the oil in the fuel as found in prior two-stroke engine, and for greater efficiency and cleaner burning, has one air intake and two exhaust valves per cylinder, is fuel injected, and has most of the moving parts operating on roller bearings.

Another object of the present invention is that it can be built to use a crankshaft to power an additional power shaft in a single or multiple piston arrangement as can the use of a grooved cylinder type power distribution system.

One more object of the present invention is that the two-stroke four cylinder design of the present invention with same cylinder bore size as the four-stroke engine has only 38 moving parts versus 127 moving parts for the current V8 four stroke engine and the present invention produces more power with less fuel consumption and less pollution.

Yet another object of the present invention is to provide an improved two-stroke engine in which most of the engine construction is the precision castings of the main body, thrust absorber, piston and rotor assembly, which means very little machine work to manufacture so that the manufacturing cost is low.

A further object of the present invention is to provide an engine structure with two main parts, a drive (piston) unit being one unit and a driven (power rotor) unit the other, which units bolt together to form the engine and can be removed each from the other in a very short time so that, should something go wrong in the piston or drive unit, a user would buy a rebuilt unit and replace it and the repair would be done to the broken unit in a repair shop at a much lower cost.

Still another object of the present invention as to overcome piston drag by changing the fulcrum point of leverage against the cylinder wall to bearing wheels.

In brief, a clean operating efficient two-stroke engine comprising a precision cast engine in two separable parts fore easy repair, a drive piston unit to provide the thrust and a driven rotor unit to translate linear thrust from the piston or drive unit into rotary power transmitted to a transportation device or other device such as a light-weight high output air compressor, wherein the piston unit has one or more cylinders with each piston rod attached to a thrust absorber carriage running on precision bearings so that the piston does not touch the cylinder walls to eliminate piston drag for a full leveraged power stroke and the thrust absorber carriage has one or more drive rods extending into one or more rotor units with cylindrical rotor drives having curved grooves in the outer surface for each to receive a drive rod in the groove to cause the rotor to rotate to transmit power via a single or double drive shaft connected to drive components of a transportation or other device so that the present invention provides a two stroke engine using full pressure lubrication through conduits to the moving parts so there is no oil in the fuel, an air intake valve on each piston for automatic self aspirating to force combusted gasses out and draw in a controlled recharge of air for the fuel air mix using controlled air valve and exhaust valve action and low pressure fuel injection, wherein the pistons run in parallel relation to the power shaft with no gears except the lubrication pump and very low power loss to operate the engine with the ability to drop or pickup cylinder operation at will (idle on one cylinder and engage others as needed).

This is the only engine design known that can be used to power a propeller driven aircraft designed to fly as a helicopter-gyrocopter without the use of gears. This engine design, because it can support up to "three" power output sources without the use of gears, allows for power to the rotary wings as well as the forward and reversible propeller.

The present invention does not use a crankshaft to distribute the developed power, instead the present invention uses a tube parallel to and spaced from the piston chamber which is grooved to except the power thrust from the thrust absorber extending perpendicularly from the piston rod and thruster assembly which turns the power shaft to drive the transmission and drive chain in a wheeled vehicle or other units or directly drive a propeller in a propeller driven vehicle. By installing a different cover on the thrust absorber to carry the crankshaft slide and a different cover on the main body to carry the crankshaft the present invention is able to have a vertical and a horizontal power shaft without the use of gears. The vertical shaft could drive the rotary wings and have a "disconnect" for autogiro use while the horizontal shaft can be used to drive the forward-reverse propeller.

An engine cycle is the time the piston starts at firing position and goes through the cycle to return to the firing position. Therefore a prior art 4 stroke cycle requires 4 strokes "a firing stroke down, a cylinder purging stroke up, a cylinder recharging stroke down, a compression stroke up to firing position to complete the cycle. In this prior art course the crankshaft turns twice with two dead strokes and piston drag as well as valve timing gears, camshaft and 4 valves per cylinder to operate thereby taking up to 31% of the power developed by that one power stroke to operate the engine. The present invention removes this waste of power, operational and manufacturing cost by eliminating two piston strokes, piston and valve assembly drag. The piston drag occurs because of the crankshaft connection to the piston by a rod having bushings at both ends. As the crankshaft moves the piston up or down the cylinder, it moves off center to the cylinder which creates a heavy piston thrust against the cylinder wall, which has to be lubricated to reduce wear. This problem is eliminated in the present invention two stroke system by the thrust absorber, which operates on roller bearings, delivering power to the power tube and without the piston touching the cylinder wall and the use of gears or valve assembly.

The purpose of the present invention is to overcome the wasted power of the four stroke engine by eliminating the piston drag, eliminating the intermittent leverage against the load factor and eliminating the extra two strokes needed for the four stroke engine. The present two stroke engine reduces engine weight, reduces fuel consumption, reduces manufacturing cost, reduces air pollution, reduces maintenance cost, and adds to the life of the existing oil reserves.

The present invention provides a piston that does the work of two without the loss of power. For example, a smaller engine with four pistons of the present invention may replace an engine with eight pistons, thereby reducing the extra weight, size and manufacturing cost as the eight cylinder has 127 moving parts the four cylinder has 28 moving parts.

The present invention incorporates the use of one exhaust valve, one intake valve, thereby eliminating the ports. The present invention uses pressure lubrication, and does not require oil in fuel thereby eliminating the need for a high head temp. The present invention has no crankshaft thereby eliminating the piston drag. There are no camshaft gears, assembly and multi-valves, therefore there are fewer parts to manufacture.

The present invention provides positive energized intake and exhaust valves. As the piston returns to the firing position it moves the purging recharge air in behind it to fill the chamber which is compressed as the piston moves down on the power stroke thereby creating the purging air to be pressurized to flow through and clean the cylinder, no outside cylinder purging unit required.

The present invention provides metered recharge of the combustion chamber as is used today, and further provides low pressure fuel injection.

The present invention is less costly to build, operate, and repair. It has less moving parts and wear factor, and has less weight per horse power. All parts move on bearings or lubricated slides thereby providing a low wear factor. It is built in two units, the drive unit and the driven unit. The main body "driven unit" is the carrier for the engine and the drive unit "piston assembly" can be removed from the main body and replaced by a rebuilt unit in one or two hours thereby allowing for faster service and less repair cost to the user.

The present invention is a more efficient less costly engine design for small aircraft, marine, automobiles, and other devices such as air compressors.

An advantage of the present invention is that it provides full leverage for the entire piston stroke.

Another advantage of the present invention is that it eliminates the drag of two extra strokes in the current structure.

A further advantage of the present invention is that it requires less weight per horse power.

Yet another advantage of the present invention is that it is less costly to repair.

One more advantage of the present invention is that it provides an engine which is more fuel efficient.

A related advantage of the present invention is that it provides the ability to drop or pickup cylinder operation at will.

An advantage of the present invention is that it operates without lubricant mixed in the fuel.

Another advantage of the present invention is that it is completely pressure lubricated.

A further advantage of the present invention is that it does not require a mechanical outside air pressure source to purge and recharge the combustion chamber.

Yet another advantage of the present invention is that is has a low wear factor.

An additional advantage of the present invention is that it has a low manufacturing cost.

A further advantage of the present invention is that it has less moving parts.

A contributory advantage of the present invention is that it is less costly to operate.

A related advantage of the present invention is that it does not use intake and exhaust ports.

An advantage of the present invention is in having the air intake valve in the piston.

Another advantage of the present invention is that it provides a unit to absorb the thrust of combustion pressures.

A further advantage of the present invention is that it eliminates the drag of the piston touching the cylinder wall.

Yet another advantage of the present invention is that it uses no gears except for the lubricant pump.

A contributory advantage of the present invention is that it may be configured for multiple power take off options without the use of gears.

A related advantage of the present invention is that it may be configured with opposing piston options.

An additional advantage of the present invention is that it is as dependable as the 4 stroke cycle engine.

A final advantage of the present invention is that it creates less air pollution.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 1:
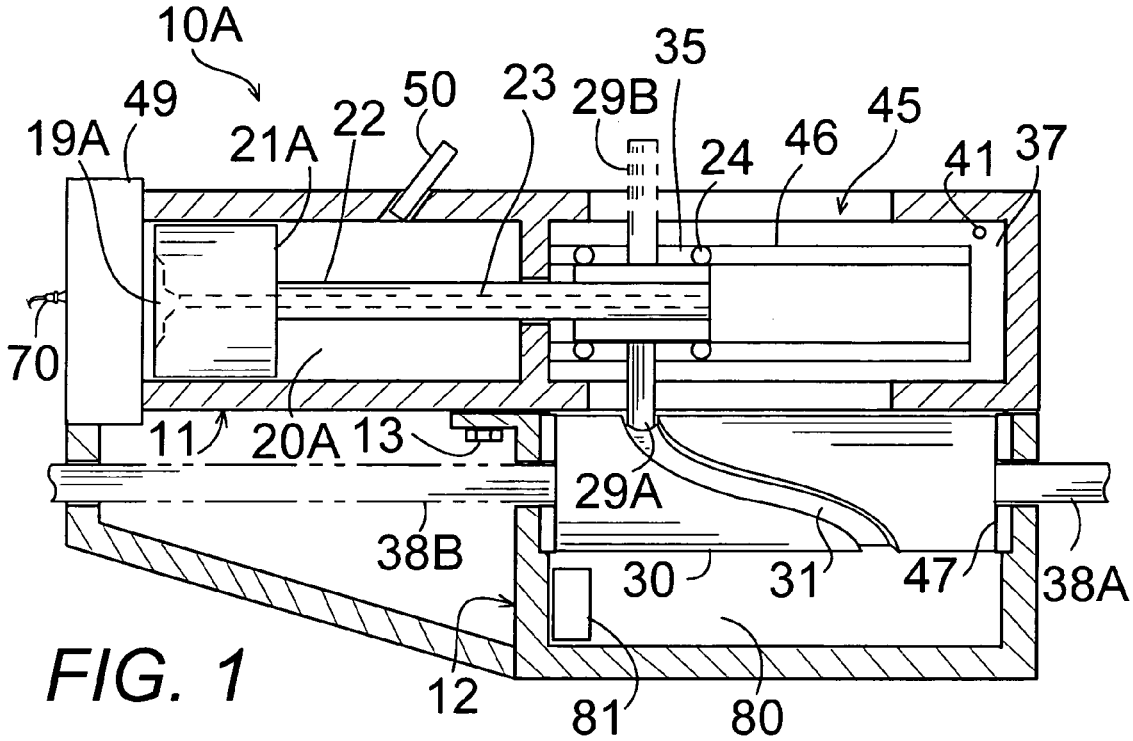
FIG. 1 is a cross-sectional view taken through the longitudinal centerline of the two unit engine of the present invention showing a single cylinder and piston drive unit and a rotary drive power unit to power a transportation or other device, showing the piston at the beginning of the combustion power stroke.

In FIGS. 1–7, a two-stroke combustion engine body 10A and 10B comprises two units: a piston unit 11 and 11A and a rotor unit 12.

The main engine body 10A and 10B is formed by precision casting. The main engine body 10A and 10B includes two main units comprising a precision cast drive piston unit 11 and 11A for providing the power to drive a transportation or other device and a precision cast driven power rotor unit 12 interconnected by bolts 13 with the piston unit 11 and 11A and being driven by the piston unit 11 and 11A to rotate the power rotor unit 12 so that the power rotor unit 12 is attachable to a transportation device drive train to move a transportation device or to another type of unit in FIGS. 1 and 2, the piston unit 11 preferably has a cylinder comprising a precision cast piston chamber 20A having an inner cylindrical piston chamber wall for performing the cycles and an adjacent thrust absorber chamber 37 for running the thrust absorber carriage 35 to maintain the alignment of the piston head 21A so that it does not contact the chamber wall. The piston unit 11 and also comprises a low pressure fuel injector 50 communicating with the piston chamber 20A through an opening in the piston wall to inject a controlled spray of fuel into the piston chamber 20A. The piston unit 11 further comprises one or more positive air recharge valves 41 in an adjacent thrust absorbing chamber 37 communicating with the piston chamber 20A via the piston shaft air intake valve 19B, the piston shaft opening 23 and the piston head air intake valve 19A for admitting a metered charge of recharge air into the piston chamber 20A to mix with the fuel.

The piston unit 11 also comprises a spark plug 70 in a cylinder head 49 communicating with the piston chamber 20A to provide a spark for combusting the air and fuel mixture. The piston unit 11 further comprises a positive energized exhaust valve 19D, shown in FIGS. 5–7, adjacent to the spark plug 70 with preferably two exhaust channels 15 communicating with the piston chamber 20A with the exhaust valve 19D in an open position for exhausting combusted gases from the piston chamber 20A to purge the piston chamber 20A so that the piston chamber 20A is self-purging.

The piston unit 11 further comprises a precision cast piston comprising a cylindrical piston head 21A having a front face and a back face and a piston rod 22 attached to the back face of the piston head 21A at a first end of the piston rod 22. The piston head 21A is movable within the piston chamber 20A in response to combustion in the piston chamber 20A. The piston head 21A has an air intake opening 18A in its front face. The piston head has an air intake opening 18A communicating with a piston shaft opening 23 running the full length of the piston head 21A and piston shaft 22.

Figure 2:
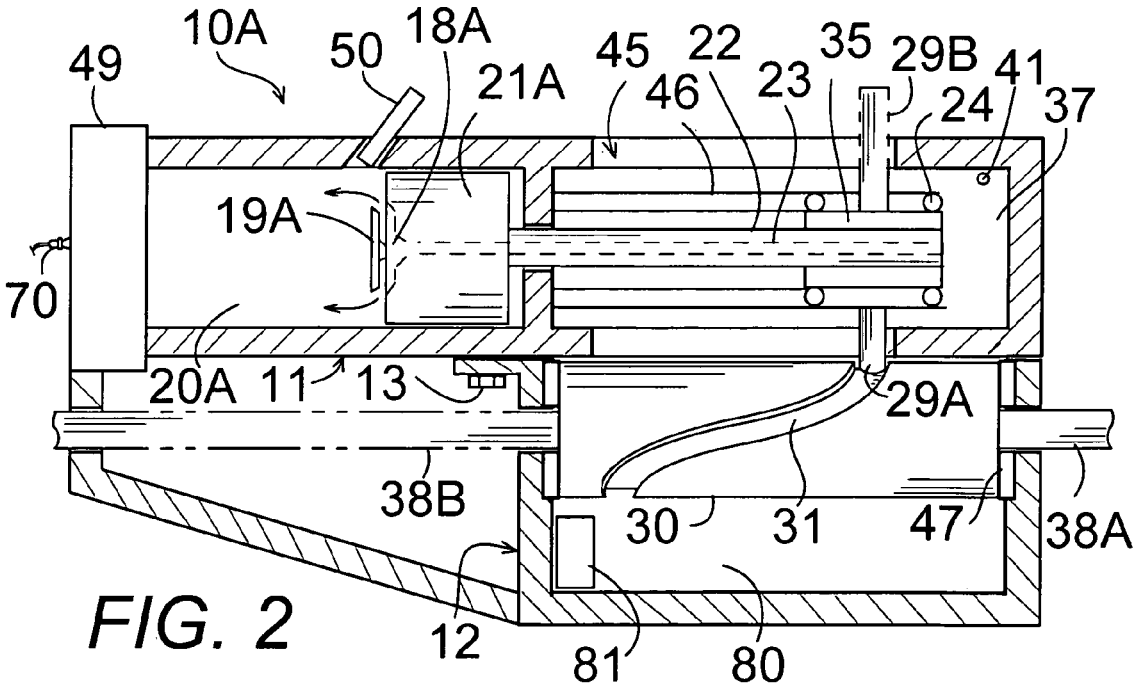
FIG. 2 is a cross-sectional view taken through the longitudinal centerline of the two unit engine of the present invention of FIG. 1 with the piston at the beginning of the exhaust and recharging stroke.

A first air intake valve 19A is installed in the air intake opening 18A with the first air intake valve 19A movable within the piston head 21A from a closed first position with the first air intake valve 19A aligned with the front face of the piston head 21A and the air intake opening 18A sealed by the first air intake valve 19A, as seen in FIG. 1, and an open second position with the first air intake valve 19A spaced apart from the front face of the piston head 21A leaving the air intake opening 18A open to admit air therethrough as shown in FIG. 2. The piston rod 22 has a central piston rod opening 23 along the length of the piston rod 22 in communication with the air intake opening 18A in the piston head 21A, and a second air intake valve 19B at a second end of the piston rod 22. The second air intake valve 19B is movable relative to the piston rod 22 between a closed first position with the second air intake valve 19B closed over the piston rod opening 23, as shown in FIG. 1 and an open second position with the second air intake valve 19B spaced apart from the piston rod opening 23 to admit air into the piston rod opening 23, as shown in FIG. 2. The piston head 21A has an end opening to accommodate a valve operating spring 36, a spring holder, a valve actuator, and grooves along the valve shaft opening to allow a lubricant to flow to piston seals and to the bearings 24 of the thrust absorber 35.

The piston unit 11 further comprises the thrust absorber chamber 37 aligned with and adjacent to the piston chamber 20A. The thrust absorber chamber 37 has an upper pair of spaced parallel tracks 46 and a lower pair of spaced parallel tracks 46 and one or more elongated openings 45 through a wall of the thrust absorber chamber 37 along the length of the thrust absorber chamber 37. The thrust absorber chamber 37 also has a piston rod opening between the thrust absorber chamber 37 and the piston chamber 20A.

A thrust absorber carriage 35 is attached to a mid portion of the piston rod 22. The thrust absorber carriage 35 comprises two spaced upper pairs of precision rolling elements 24 and two spaced lower pairs of precision rolling elements 24 attached to the thrust absorber carriage 35, so that the two upper pairs of rolling elements 24 ride in the upper pair of spaced parallel tracks 46 and the one or two lower pairs of rolling elements 24 ride in the lower pair of spaced parallel tracks 46 to guide the movement of the piston 21A so that there is no friction between the piston 21A and the piston chamber 20A wall for a highly efficient movement of the piston 21A within the piston chamber 20A. The thrust absorber carriage 35 further comprises one or preferably two thrust rods 29A and 29B extending orthogonally from the thrust absorber carriage 35 and through the elongated opening 45 through a wall of the thrust absorber chamber 37 to connect with the rotor unit 12.

The rotor unit 12 comprises a grooved cylinder type power distribution system positioned adjacent to the piston unit 11 or 11A. The rotor unit 12 is interconnected by one or more rotary drive shafts 38A and 38B with a means for driving a transportation device, such as a transmission in a vehicle or any rotary drive elements such as propellers or rotary drive chains. The rotor unit 12 comprises a grooved cylindrical power rotor 30 attached to the engine body by two thrust rod or rods 47. The power rotor 30 is positioned parallel to and spaced from the piston chamber 20A. The power rotor 30 has an external curved groove 31 in the power rotor 30 to receive a thrust rod 29A and 29B moving within the curved groove 31 to turn the power rotor 30 to transmit power to the means for driving a transportation device. The thrust rod 29A and 29B comprises two thrust rods 29A and 29B extending from the thrust absorbing carriage 35 in different orthogonal directions and may further comprise an additional rotor unit 12 for each of the thrust rods 29A and 29B attached to a different side of the piston unit 11 to provide additional drives for different components of transportation devices.

Alternately, a vertical rotor unit (not shown) drives a rotary wing of a flying transportation device and a horizontal rotor unit drives a propeller of the flying transportation device both without the use of gears for flying vertically and horizontally.

During a power stroke (FIG. 1 shows the position of the piston head 21A at the beginning of the power stroke) fueled by low-pressure electronic fuel injection mixed with air electronically ignited to combustion by the spark plug 70, the piston head 21A is thrust away from the spark plug 70 with the thrust absorber carriage 35 absorbing the thrust and aligning the movement of the piston head 21A so that the piston head 21A moves without contacting the piston cylinder 20A wall and the thruster rod 29A and 29B moves within the curved groove 31 in the power rotor 30 to turn the power rotor 30 to transmit power to drive a transportation device.

Figure 5:
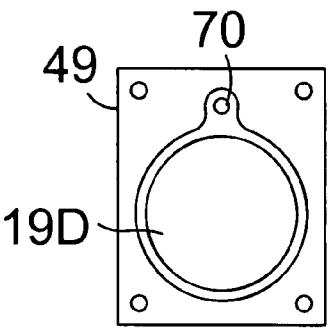
FIG. 5 is a front elevational view of the cylinder head of the present invention having an automatic exhaust valve and a spark plug.
Figure 6:
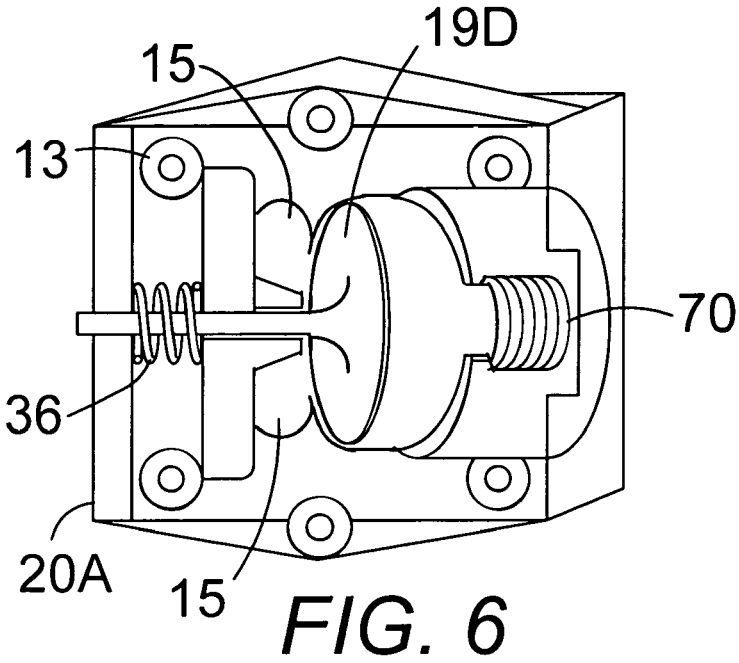
FIG. 6 is a partial sectional perspective view of the cylinder head of the present invention having an automatic exhaust valve and a spark plug.
Figure 7:
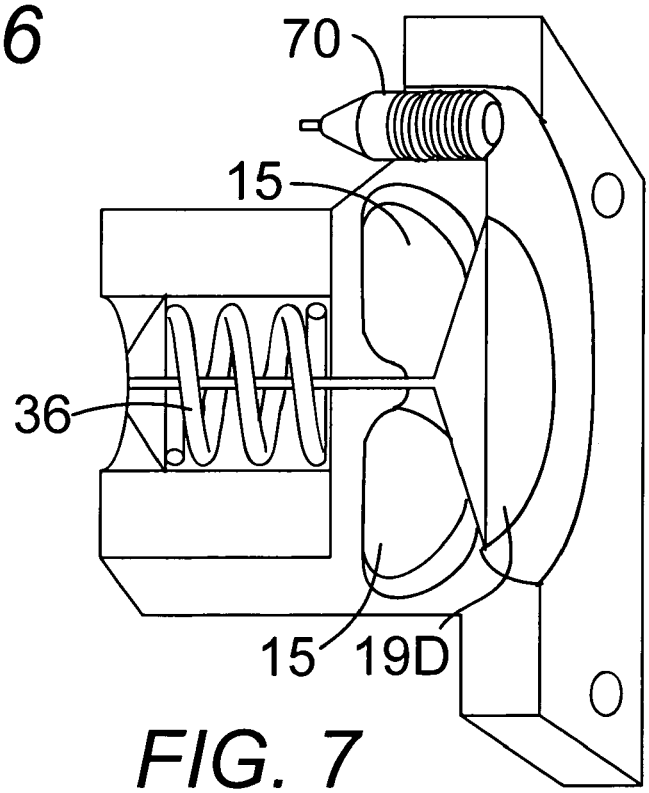
FIG. 7 is a partial sectional perspective view of the cylinder head of the present invention having an automatic exhaust valve and a spark plug.

At an end of the power stroke, as shown in FIG. 2, the exhaust valve 19D in the cylinder head 49, as shown in FIGS. 5–7, opens to release the combustion gas pressure at which time the piston head air intake valve 19A and the piston rod air intake valve 19B open to release pressurized purging air from the positive air recharge valve(s) 41 and purge the combustion gases from the piston chamber 20A, and as the exhaust valve 19D closes, controlled recharge air enters the combustion chamber 20A through the air intake valve 19A and the air intake valve 19A closes when the combustion chamber 20A is recharged and the positive air intake valve 41 then unlocks to open behind the piston 21A and allows the purging chamber 20A to refill as the piston head 21A returns in a chamber compression stroke to a firing position at the spark plug 70 end of the piston chamber 20A. The purging air chamber valve 19D electronically relocks to start the next combustion power stroke.

The moving parts 22 and 35 of the engine 10A and 10B are pressure lubricated by an oil pump 81 which takes oil from a sump 80 below the drive rotor 30 and pumps the oil in conduits to the moving parts of the invention separate from the combustion in the piston chamber 20A. The oil pump 81 pumps oil under pressure to flow from the pump 81 to piston seals (not shown) and an oil groove (not shown) in a piston bushing (not shown). The lubricant sump 80 is located at the bottom of the rotor unit 12 wherein the power rotor 30 operates partially in the lubricant sump 80. Most of the moving parts are operating on bearings.

In FIGS. 1 and 2, the second air intake valve 19B is supported by the shared thrust absorber carriage 35, the second air intake valve 19B further comprising a valve operating system to open and close the valve as desired.

Figure 3:
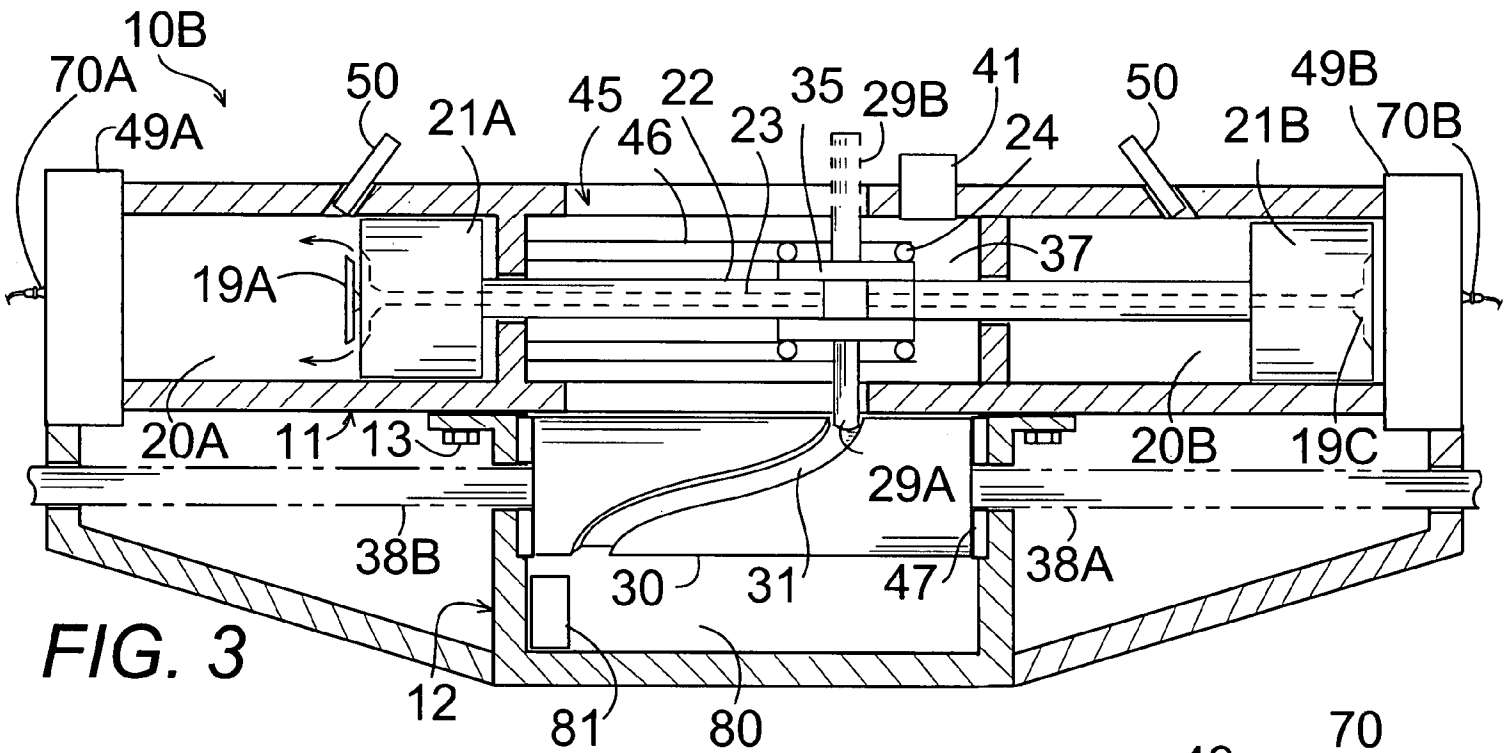
FIG. 3 is a cross-sectional view taken through the longitudinal centerline of the two unit engine of the present invention showing a double piston cylinder and piston drive unit with aligned pistons sharing the same thrust absorber carriage and a rotary drive power unit to power a transportation or other device, showing the right piston at the beginning of the combustion power stroke and the left piston at the beginning of the exhaust and air recharging stroke.
Figure 4:
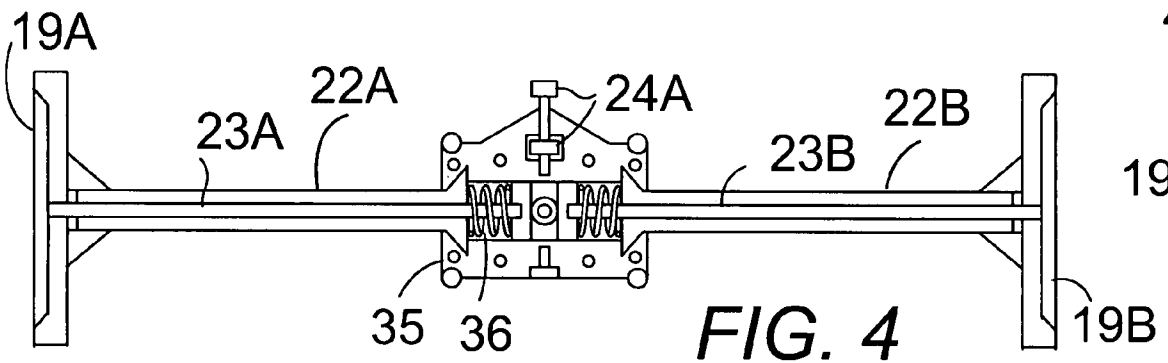
FIG. 4 is a plan diagrammatic view of the thrust absorber carriage of the present invention showing the air intake valve of each of the two pistons attached to an air intake mechanism on the thrust absorber carriage.

In FIGS. 3, 4, and 5, an alternate embodiment wherein the piston unit 11A may comprise two piston cylinders 20A and 20B positioned in linear alignment. The piston unit 11A comprises a pair of piston heads 21A and 21B mounted with each of the piston shafts 22 mounted on a shared thrust absorber carriage 35 in a single thrust absorber chamber 37 between the two piston heads 21A and 21B moving within one of two separate piston chambers 20A and 20B. FIGS. 4 and 5 show the air intake valves with springs 36 on the two valves on a shared carriage 35.

In FIG. 3, the engine body 10B may comprise two opposing cylinders 20A and 20B run on one thrust absorber carriage 35. This arrangement allows the engine body 10B to carry up to six cylinders of any size bore or stroke.

In FIGS. 6 and 7, the cylinder head 49 has an automatic exhaust valve 19D with a spring 36 and a spark plug 70.

The piston unit 11 or 11A and the power unit 12 are bolted together by bolts 13 along a seam to form the engine body 10A or 10B so that each of the units 11, 11A or 12 can be unbolted and removed from the engine body 10A or 10B and replaced by a replacement unit when the unit 11, 11A or 12 is damaged so that the unit 11, 11A or 12 may be rebuilt to use in another engine. The seam where the units 11 or 11A and 12 bolt together an edge of each unit 11, 11A and 12 has a half of a small seal tube cast into the edge to accommodate a round rubber seal (not shown) to seal a lubricant in the unit and a half of a lubricant tube cast beside the seal tube to move a pressurized lubricant to all parts of the engine body 10A or 10B. The engine body 10A and 10B further comprises a series of spaced dowel pins (not shown) positioned in mating holes (not shown) between the two units 11 or 11A and 12 along the seam to hold the two units 11 or 11A and 12 in precise alignment.

The engine body 10A and 10B further comprises carrier mounts (not shown) located outside on the engine body 10A and 10B to position and mount the engine 10A and 10B in a transportation device.

The present invention provides a two stroke engine 10A and 10B with the following advantages: no mixing oil in fuel, full pressure lubrication, self aspiration, controlled valve action, full leverage of power stroke, power directed to rotor shaft 30 (no crankshaft), reduced drag factor, controlled air charge to the piston cylinder 20A and 20B, no piston drag, low pressure fuel injection, it is constructed in two parts driven 12 and drive units 11 or 11A for easy repair, the piston(s) 21A and 21B run in parallel position to a power shaft 38A and 38B, no gears except the lubrication pump 81, very low power loss to operate the engine 10A and 10B, ability to drop or pickup cylinder operation at will (idle on one cylinder and engage others as needed), the piston 21A and 21B does not touch cylinder wall thereby no piston drag is created, and the engine 10A and 10B can have up to three power shafts 38A and 38B without the use of gears.

The two-stroke internal combustion engine 10A and 10B of the present invention is configured specifically to operate without lubrication mixed in the fuel, to have no port openings and to move the gases in and out of the combustion chamber 20A without the use of a mechanical outside air pressure source to purge and recharge the combustion chamber 20A.

The two-stroke engine 10A and 10B of the present invention reduces the heavy operating power loss of the four-stroke engine by eliminating the piston drag on the cylinder wall and the drag of the extra two piston strokes needed by the four stroke engine.

The two-stroke engine 10A and 10B of the present invention reduces the number of moving parts and weight thereby reducing the operating and manufacturing cost to the consumer. By eliminating the operating power loss of the four stroke engine, the engine 10A and 10B of the present invention uses that power to reduce fuel consumption and air pollution.

In use, due to its simplicity, the two stroke engine 10A and 10B of the present invention is easy to build as the top and bottom precision castings 11 or 11A and 12, comprise the main body, and are made to accommodate the running areas for all moving parts. On the edges where they bolt together each has half of a small tube cast (not shown) in it to accommodate a round rubber seal (not shown) to seal the lubricant in the unit 10A and 10B. They each also have a half tube cast (not shown) beside the seal tube to move the pressurized lubricant to all parts of the engine 10A and 10B. There are four dowel pins (not shown) to hold the top 11 or 11A and bottom 12 in precise alignment and carrier mounts (not shown) located outside on the casting to position the engine 10A and 10B.

The moving parts consist of the thrust absorber carriage 35 which runs in the tracks 46 in the thrust absorber chamber 37 to accommodate the roller wheels 24 or 24A of the thrust absorber 35, which in turn carries the power thrust rod 29A and 29B which delivers the power from the piston 21A and 21B to the power rotor 30 attached to the main body 12 by two thrust bearings 47. The thrust absorber carriage 35 also carries the piston(s) 21A and 21B, air intake valves 19A and 19B and valve operating system with the valve-actuating unit operating in a groove located in the main body.

The piston 21A having the air intake valve shaft running the full length of it also has an opening in the end to accommodate the valve operating spring 36 and valve actuator and has grooves along the valve shaft opening to allow the lubricant to flow to the thrust absorber bearings 24 as well as the piston seals.

Before the thrust absorber carriage 35 is bolted together, the air intake valve operating spring 36, spring holder and actuator must be installed in the piston head 21A end. The oil air shield, oil air seal carrier, and piston shaft bushing (none shown) must be placed on the piston shaft 22 and then the piston shaft 22 can be inserted into the thrust absorber carriage 35 and the top and bottom of the thrust absorber carriage 35 are then bolted together with the piston shaft 22 attached to become one unit. This unit can then be installed with the bushings or bearings 24 put in place in the openings or tracks 46 cast in the main body 11 or 11A and the power thrust rod 29A and 29B inserted into the power rotor 30 and the main body cover installed. The oil air seal and holder (not shown) can then be bolted to the main body leaving the piston 21A or 21B protruding with the oil air shield hanging on it. The piston seals are then installed on the piston 21A and 21B and the cylinder 20A and 20B slid onto and over the piston 21A or 21B and bolted to the main body 11 or 11A with the air oil shield between them. The push rod for the exhaust valve 19D is then placed with the oil drain tube around it and the cylinder head 49, 49A or 49B then installed.

The power rotor 30 operates partially in the lubricant sump 80 which has fins on the outside to cool the lubricant and a tube around the power rotor shaft going to the outside rotor shaft carrier bearing 47 and exhaust valve activating lobe. This tube (not shown) carries the lubricant to the carrier bearing 47 and exhaust valve-operating mechanism and an outer tube over the rotor shaft returns the lubricant to the sump 80.

The operational flow of the present invention 10A and 10B is unique in that it starts with the power stroke fueled by low-pressure electronic fuel injection electronically ignited by the spark plug 70 to move the piston 21A, without it touching the cylinder walls, down to a full stroke to deliver the power to the power rotor 30 for use. At the end of the power stroke, as shown in FIG. 2, the exhaust valve 19D, shown in FIGS. 5–7, opens to release the combustion gas pressure at which time the air intake valve 19A opens to release the pressurized purging air through the air intake valve 19A. As the exhaust valve 19D closes the combustion chamber 20A, the controlled recharge air enters the combustion chamber 20A and the air intake valve 19A closes. With the combustion chamber 20A recharged, the purging air chamber valves 41 then unlock to open behind the piston 21A and allow the purging chamber to refill as the piston 21A returns to firing position then electronically relocks to start the next cycle.

The present invention has two interconnected units forming the engine: the piston and power assembly 11 or 11A as shown and named as the "drive unit" and having its own specific castings to be made to fit the castings of the driven unit 12 named as the "driven unit" 12 which has its own specific castings for any size engine. The drive unit 11 or 11A with the fuel injectors and electrical connections removed can be unbolted from the driven unit 12 and a newer rebuilt unit replaced or the power rotor 30 and drive shafts 38A and 38B can be replaced by removing the thrust bearing 47 holding plates from the casting 12 and the power rotor 30 and drive shafts 38A and 38B removed and replaced in a very short time thereby reducing the tooling and cost required by the manufacturer and the repair cost to the consumer.

The multiple power shaft engine (not shown) as well as the crankshaft model (not shown) embodiments require the thrust absorber carriage 35 to have a different casting for the top plate which has the crankshaft box in which the crankshaft and bearing operates cast on it. The main body casting also has to be changed to accommodate the crankshaft assembly and the crankshaft box slide in the main body. This again saves manufacturing cost as the changes needed to add the extra power shaft are only the castings; all other parts operate and remain the same.

The pressured oil flows from the pump 81 to the driving unit 11 and 11A and is distributed to the piston seals (not shown) through the piston bushing (not shown) which has an oil groove around the center inside which matches an oil hole in the top of the piston shaft 22 when the piston 21A is at top dead center. The flow then enters the piston seal area and is distributed on the cylinder wall to be moved down the wall to the area behind the bottom part of the piston 21A and behind the air oil shield, which removes it from the purging air flow, into a sump 80 to be pushed thru a valve at the bottom of the sump area 80 and behind the air oil shield into the main oil sump 80. The oil flow also goes through the piston shaft 22, air intake valve stem guide and into the thrust absorber carriage 35 where it is distributed to all parts including the power thrust bearing 47. The oil flow going the other direction lubricates the power rotor thrust bearings 47 as well as the outer shaft bearings and exhaust valve operating system with the oil returned via the tube around the rotor shaft 30.

The present invention overcomes the wasted power of the four stroke engine by eliminating the piston drag, eliminating the intermittent leverage against the load factor and eliminating the extra two strokes needed for the four stroke engine. The present two stroke engine reduces engine weight, reduces fuel consumption, reduces manufacturing cost, reduces air pollution, reduces maintenance cost, and adds to the life of the existing oil reserves.

It is understood that the preceding description is given merely by way of illustration and not in limitation of the invention and that various modifications may be made thereto without departing from the spirit of the invention as claimed.

What is claimed is:

1. A two-stroke combustion engine comprising:

a main engine body formed by precision casting, the main engine body comprising two main units comprising a precision cast drive piston unit for providing the power to drive a vehicle or other device and a precision cast driven power rotor unit interconnected with and being driven by the piston unit to rotate the power rotor unit so that the power rotor unit is attachable to a transportation device drive train to move a transportation device or to another device to provide a rotary motion usable by the device;

the piston unit comprising at least one cylinder comprising a precision cast piston chamber having an inner cylindrical piston chamber wall; a low pressure fuel injector communicating with the piston chamber through an opening in the piston wall or installed in a piston head to inject a controlled spray of fuel into the piston chamber; at least one positive air intake valve communicating with the piston chamber for admitting a metered charge of recharge air into the piston chamber to mix with the fuel; a spark plug communicating with the piston chamber to provide a spark for combusting the air and fuel mixture; at least one positive energized exhaust valve adjacent to the spark plug with at least one exhaust channel communicating with the piston chamber with the exhaust valve in an open position for exhausting combusted gases from the piston chamber to purge the piston chamber so that the piston chamber is self-purging; a precision cast piston comprising a cylindrical piston head having a front face and a back face and a piston rod attached to the back face of the piston head at a first end of the piston rod, the piston head movable within the piston chamber in response to combustion in the piston chamber, the piston head having an air intake opening in the front face of the piston head, and a first air intake valve installed in the air intake opening with the first air intake valve movable within the piston head from a closed first position with the first air intake valve aligned with the front face of the piston head and the air intake opening sealed by the first air intake valve and an open second position with the first air intake valve spaced apart from the front face of the piston head leaving the air intake opening open to admit air therethrough, the piston rod having a central piston rod opening along the length of the piston rod in communication with the air intake opening in the piston head, and a second air intake valve at a second end of the piston rod, the second air intake valve movable relative to the piston rod between a closed first position with the second air intake valve closed over the piston rod opening and an open second position with the second air intake valve spaced apart from the piston rod opening to admit air into the piston rod opening;

the piston unit further comprising a thrust absorber comprising a chamber aligned with and adjacent to the piston chamber, the thrust absorber chamber having an upper pair of spaced parallel tracks and a lower pair of spaced parallel tracks and at least one elongated opening through a wall of the thrust absorber chamber along the length of the thrust absorber chamber and a piston rod opening between the thrust absorber chamber and the piston chamber; a thrust absorber carriage attached to an end portion of the piston rod, the thrust absorber carriage comprising at least one upper pair of precision rolling elements and at least one lower pair of precision rolling elements attached to the thrust absorber carriage, so that the at least one upper pair of rolling elements ride in the upper pair of spaced parallel tracks and the at least one lower pair of rolling elements ride in the lower pair of spaced parallel tracks to guide the movement of the piston so that there is no friction between the piston and the piston chamber wall for a highly efficient movement of the piston within the piston chamber; the thrust absorber carriage further comprising at least one thrust rod extending orthogonally from the thrust absorber carriage and through the at least one elongated opening through a wall of the thrust absorber chamber to connect with the rotor unit;

the rotor unit comprising a grooved cylinder type power distribution system positioned adjacent to the piston unit, the rotor unit interconnected with a means for driving a transportation device, the rotor unit comprising a grooved cylindrical power rotor attached to the engine body by two thrust bearings, the power rotor positioned parallel to and spaced from the piston chamber, the power rotor having an external curved groove in the power rotor to receive the at least one thrust rod moving within the curved groove to turn the power rotor to transmit power to the means for driving a transportation or other device;

so that during a power stroke fueled by low-pressure electronic fuel injection mixed with air electronically ignited to combustion by the spark plug, the piston head is thrust away from the spark plug with the thrust absorber carriage absorbing the thrust and aligning the movement of the piston heads so that the piston head moves without contacting the piston cylinder wall and the at least one thruster rod moves within the curved groove in the power rotor to turn the power rotor to transmit power to drive a transportation or other device, and at an end of the power stroke the at least one exhaust valve opens to release the combustion gas pressure at which time the air intake valves on the piston head and piston rod open to release pressurized purging air from the at least one positive air intake valve and purge the combustion gases from the piston chamber, and as the exhaust valve closes, controlled recharge air enters the combustion chamber through the at least one positive air intake valve and the air intake valve closes when the combustion chamber is recharged and the at least one electronically controlled air intake valve then unlocks to open behind the piston and allow the purging chamber to refill as the piston head returns in a chamber compression stroke to a firing position at the spark plug end of the piston chamber, and the at least one purging air chamber valve electronically relocks to start the next combustion power stroke;

wherein moving parts of the engine are pressure lubricated in conduits separate from the combustion in the piston chamber.

2. The engine of claim 1 wherein the piston unit and the power unit are bolted together along a seam to form the engine body so that each of the units can be unbolted and removed from the engine body and replaced by a replacement unit when the unit is damaged so that the unit may be rebuilt to use in another engine.

3. The engine of claim 2 wherein on the seam where the units bolt together an edge of each unit has a half of a small seal tube cast into the edge to accommodate a round rubber seal to seal a lubricant in the unit and a half of a lubricant tube cast beside the seal tube and other channels to move a pressurized lubricant to all parts of the engine.

4. The engine of claim 2 further comprising a series of spaced dowel pins positioned in mating holes between the two units along the seam to hold the two units in precise alignment.

5. The engine of claim 1 wherein the at least one thrust rod comprises at least two thrust rods extending from the thrust absorbing carriage in different orthogonal directions and further comprising an additional power receiving unit for each of the thrust rods attached to a different side of the piston unit to provide additional drives for different components of transportation and other devices.

6. The engine of claim 5 wherein a vertical drive unit drives a rotary wing of a flying transportation device and a horizontal rotor unit drives a propeller of the flying transportation device both without the use of gears for flying vertically and horizontally.

7. The engine of claim 1 wherein the piston unit comprises at least two piston cylinders positioned in linear alignment.

8. The engine of claim 1 wherein the piston unit comprises a pair of piston heads and piston rods, each piston head moving within one of two separate piston chambers in linear alignment sandwiching a single thrust absorber chamber and single thrust absorber carriage therebetween attached to both piston rods.

9. The engine of claim 1 wherein the at least one piston head air intake opening comprises an air intake valve shaft running the full length of the piston head and piston shaft, the piston head having an end opening to accommodate a valve operating spring, a spring holder, a valve actuator, and grooves along the valve shaft opening to allow a lubricant to flow to piston seals and to the thrust absorber bearings.

10. The engine of claim 1 wherein the second air intake valve is supported by the thrust absorber carriage, the second air intake valve further comprising a valve operating system.

11. The engine of claim 1 wherein most of the moving parts are operating on roller bearings.

12. The engine of claim 1 further comprising an oil pump to pump oil under pressure to flow from the pump to piston seals and an oil groove in a piston bushing.

13. The engine of claim 1 further comprising carrier mounts located outside on the engine body to position and mount the engine in a transportation device.

14. The engine of claim 1 further comprising a lubricant sump at a bottom of the rotor unit wherein the power rotor operates partially in the lubricant sump.

* * * * *